United States Patent [19]

Rosendall

[11] 4,325,156

[45] Apr. 20, 1982

[54] FLOOR SWEEPER WITH IMPROVED CONSTRUCTION

[75] Inventor: Henry J. Rosendall, Grand Rapids, Mich.

[73] Assignee: Bissell, Inc., Grand Rapids, Mich.

[21] Appl. No.: 212,857

[22] Filed: Dec. 4, 1980

[51] Int. Cl.[3] ..... A47L 11/33

[52] U.S. Cl. ..... 15/41 R

[58] Field of Search ..... 15/41–48, 15/49 C, 383, 384

[56] References Cited

U.S. PATENT DOCUMENTS

| | | | |
|---|---|---|---|
| 426,116 | 4/1890 | Drew | 15/41 R |
| 3,457,575 | 7/1969 | Bienek | 15/41 A |
| 3,789,454 | 2/1974 | Drappeu et al. | 15/41 R |
| 4,219,897 | 9/1980 | Liebscher et al. | 15/41 R |

*Primary Examiner*—Edward L. Roberts

*Attorney, Agent, or Firm*—Andrus, Sceales, Starke & Sawall

[57] ABSTRACT

A dual deflector element is disposed centrally of the lower unit of a floor sweeper and is adapted to serve two uni-directional brush rollers, disposed between the deflector and respective front and rear dust pans. The front brush roller tends to be more efficient in picking up large debris than the rear brush roller. A single center-mounted drive means is provided which serves both brush rollers. The lower unit frame or housing includes end walls and a central tansverse top portion extending therebetween, and a pair of upwardly removable dust pans are adapted for insertion between the end walls adjacent the forward and trailing edges of the top portion. Latch devices asociated with the end walls cooperate with the dust pans ends to hold the pans in position. The housing top portion includes downward extending end flanges which are riveted to the housing end walls, with the rivet heads forming the bail detents. End caps are mounted over the housing end walls and cooperate therewith in mounting springs, the ends of which form stub axles for four sweeper support wheels. The four support wheels float generally vertically on their springs, with upper stops for the springs serving also as lower seats for the flanges of the housing top portion. The upper stops permit the four support wheels to floatingly rise further than the drive wheels.

21 Claims, 14 Drawing Figures

FLOOR SWEEPER WITH IMPROVED CONSTRUCTION

BACKGROUND AND SUMMARY OF THE INVENTION

This invention relates to a floor sweeper having an improved construction.

Floor sweepers having one or more rotatable brush rollers for sweeping debris into an adjacent dust pan have long been known. Although commonly called carpet sweepers, in recent years these devices have been developed to the point where they function very adequately on smooth floors as well as carpets. See, for example, U.S. Pat. No. 3,457,575 entitled "Sweeper For Carpeted And Smooth Floors."

Modern day floor sweepers are expected to pick up a variety of different types of debris including not only lint, thread, sand and the like, but also larger items such as cigarette butts.

The aforesaid U.S. patent discloses embodiments of a two brush sweeper utilizing identical brush rollers of the tufted type which sweep continuously toward their respective pans and which have a flicking action. The brush rollers are alternately driven and free wheel, but the direction of rotation remains the same. Each brush roller is driven by a separate pair of drive wheels. In a first embodiment, the said patent discloses a construction wherein the dust pans and drive wheels are disposed between the brush rollers. In a second embodiment, the brush rollers are disposed between and inwardly of the dust pans and drive wheels.

In both embodiments of the aforesaid U.S. Pat. No. 3,457,575, the brush rollers sweep toward the lower edge of the respective pans, with debris moving up and into the pans. The pans are disposed very low in the sweeper to reduce any tendency for debris to be swept under them. This creates a problem in that large debris, such as cigarette butts, may be engaged by the low pans and either pushed along or squeezed against the floor, rather than being picked up by the brush roller. It would therefore be desirable to raise the pans higher off the floor.

A more recent construction of single brush sweeper has made it possible to raise the dust pan. In this known construction, a brush roller is mounted between a front mounted curved deflector and a rear mounted dust pan. In this instance the brush roller alternately is driven and free wheels in a direction so that debris picked up by the brush roller is carried up along the deflector and then flung generally downwardly into the pan. However, in this device, the deflector is low to the floor and at least occasionally tends to push large debris ahead of itself on the forward stroke so that the brush does not reach the debris.

In designing floor sweepers of improved construction, problems are always found relative to the placement and mounting of the various elements. This is especially true in connection with the wheels and brush rollers, retaining springs, dust pans, bail, and the like. It is important that the lower unit of a floor sweeper be designed so that it can be manufactured economically, as well as assembled and serviced with a minimum of difficulty. The elements of the sweeper should cooperate and function in the most efficient manner possible, keeping in mind the need for a compact unit which is visually attractive. Not all designs are highly efficient.

For example, it is known to provide separate upwardly removable dust pans having peripheral shoulders which cooperate with an upper peripheral ledge on the sweeper housing so that the ledge supports the pans. Alternately, the floors of upwardly removable pans are sometimes supported by bottom walls in the housing. The shoulder-ledge support requires a relatively massive type of pan and housing wall construction, while the bottom wall support may require a deeper pan than necessary, all of which may be wasteful of the materials used.

As another example, bail detents have often been formed of special parts useful for the detent alone, thus requiring separate manufacturing operations for this relatively simple device.

As a further example, the support wheels of prior sweepers have not always been positioned or adapted to function in a manner to promote overall sweeper efficiency.

It is a task of the present invention to provide a two brush floor sweeper of improved construction wherein any elements adjacent the brushes are positioned above the floor of sufficient distance so as not to interfere with the debris being swept up.

It is a further task of the invention to provide an improved placement and mounting of many of the various elements associated with the lower unit of the sweeper.

In accordance with one aspect of the invention, a dual deflector element is disposed centrally of the lower unit and is adapted to serve two uni-directional brush rollers, with the brush rollers being disposed between the deflector and respective dust pans which are disposed at the front and rear of the sweeper. The front brush roller tends to be more efficient in picking up large debris than the rear brush roller. Thus, in the combination, both the pans and deflector can be raised higher off the floor than previously.

In accordance with other aspects of the invention, a single center-mounted drive means is provided which serves both brush rollers. The central drive means includes an axle having end mounted drive wheels. The axle extends within the deflector element, the latter also mounting a biasing spring for the axle, which floats.

In accordance with further aspects of the invention, the lower unit frame or housing includes end walls and a central transverse top portion extending therebetween, and a pair of upwardly removable dust pans are adapted for insertion between the end walls adjacent the forward and trailing edges of the top portion. Latch devices associated with the end walls cooperate with the dust pan ends to hold the pans in position and also to support them in spaced relation above the housing bottom. The housing top portion includes downwardly extending end flanges which are riveted to the housing end walls, with the rivet heads forming the bail detents.

In accordance with additional aspects of the invention, end caps are mounted over the housing end walls and cooperate therewith in mounting springs, the ends of which form stub axles for four sweeper support wheels disposed between the caps and end walls. The four support wheels float generally vertically on their springs, with upper stops for the springs serving also as lower seats for the flanges of the housing top portion. The upper stops permit the four support wheels to floatingly rise further than the drive wheels. A brush axle mounting plate is secured to the inside of each end cap.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
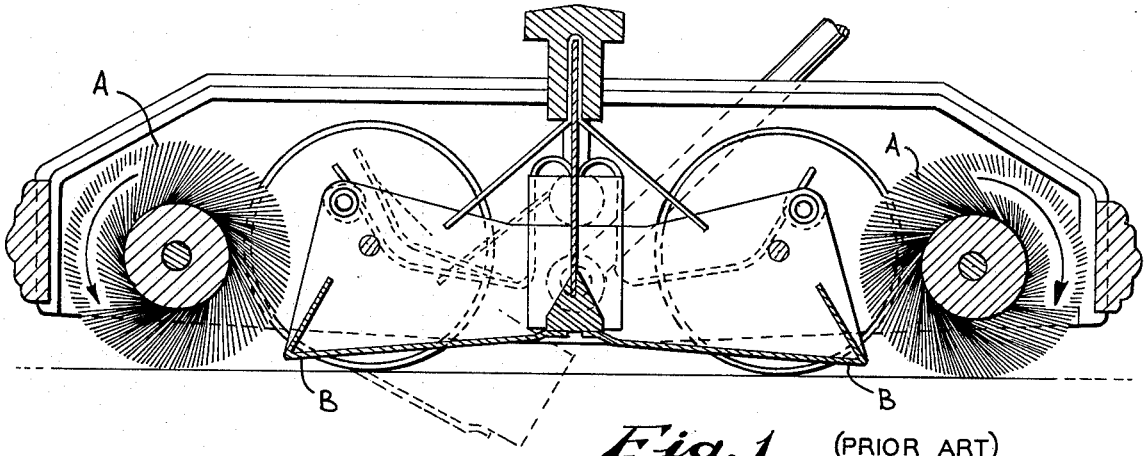
Fig. 1 (PRIOR ART)
FIG. 1 is a sectional view of one form of known floor sweeper.

FIG. 1 illustrates one form of prior art floor sweeper of the type disclosed in the aforementioned U.S. Pat. No. 3,457,575 wherein a pair of brush rollers A are disposed fore and aft of the lower unit with dust pans B disposed inwardly of the brush rollers. Rollers A include bristles of the tufted flicking type and rotate continuously toward their respective pans B upon both forward and rearward translation of the sweeper on the floor. Rollers A sweep toward the lower edge of their respective pans B, so that the pans need to be disposed closely adjacent the floor to prevent debris from being swept under the pans.

Figure 2:
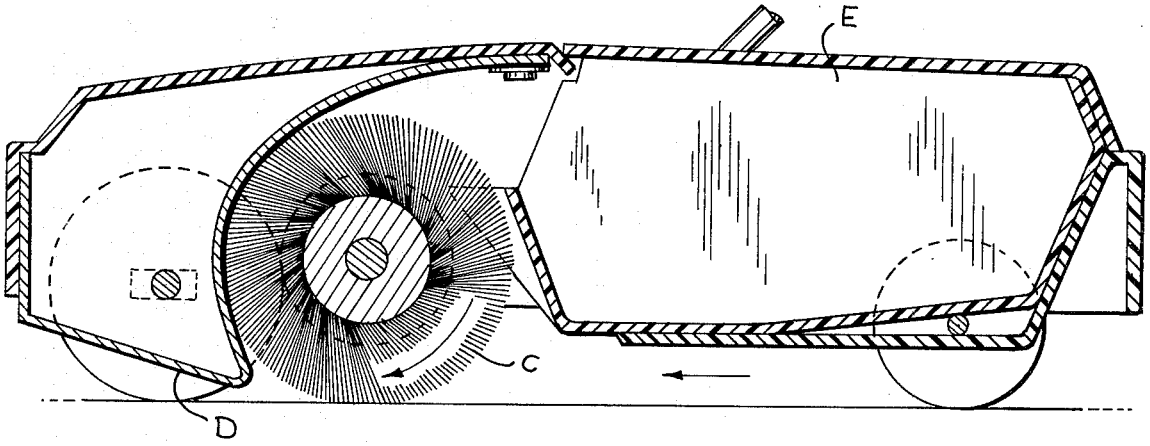
Fig. 2 (PRIOR ART)
FIG. 2 is a sectional view of another form of known floor sweeper.

FIG. 2 illustrates another form of prior art floor sweeper wherein a single brush roller C is disposed between a forwardly mounted deflector D and a rearwardly mounted dust pan E. In this instance, brush roller C is also of the tufted bristle flicking type, but it is arranged to rotate continuously in a direction opposite from FIG. 1. That is, it sweeps away from the pan and toward deflector D where it carries debris up along the deflector surface and hence downwardly into the pan. With this construction, pan E is raised relatively high off the floor, but deflector D is disposed with its lower edge close to the floor to prevent the brush roller from sweeping any appreciable amount of debris beneath it. In this instance, deflector D may push large debris ahead of it on the forward stroke so that the debris is not picked up by the brush roller.

The floor sweeper of the present invention is illustrated in FIGS. 3–14 of the drawings and comprises generally the usual handle 1, bail 2 and lower sweeping unit 3.

Lower unit 3 includes a frame comprising transversely spaced longitudinally extending end plates 4 joined by front and rear transversely extending brace members 5, and also by a transverse top member 6. A longitudinal cap 7, preferably of plastic, is secured to each end wall 4, as by screws 8, and together therewith forms a chamber 9 for receiving the sweeper's support and drive mechanism.

Top member 6 includes downwardly extending end flanges 10 which fit over upwardly extending central portions 11 of end plates 4 and which are seated on a pair of outwardly extending locating stops 12 formed in plates 4. Flanges 10 and central portions 11 are joined together by securing means which in this instance comprises a pair of longitudinally spaced rivets 13. See, particularly, FIGS. 1, 2, 8, 9 and 14. The ends of bail 2 are journalled in end plates 4 and extend upwardly through slotted portions in caps 7 adjacent rivets 13. The construction is such that the heads of rivets 13 form the detents for positioning bail 2 relative to lower unit 3.

Figure 8:
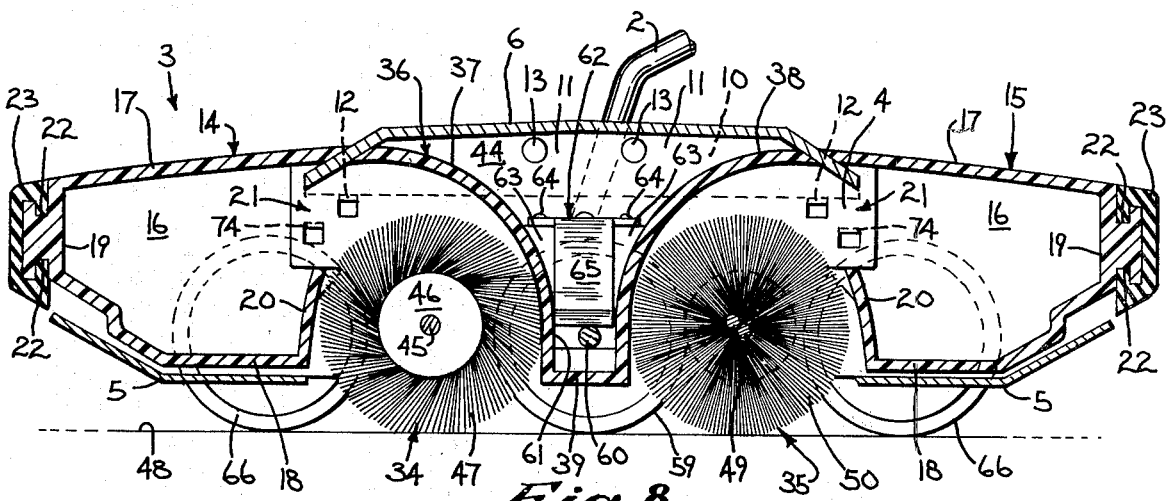
FIG. 8 is a central longitudinal section taken on line 8—8 of FIG. 4.

A pair of upwardly removable dust pans 14, 15 are provided for lower unit 3, with the pans being disposed at and forming the front and rear extremeties of the unit. Each pan 14, 15 includes the usual end walls 16, a top wall 17 which cooperates with top member 6 to cover the lower unit, a bottom wall 18, an outer wall 19, and an upstanding inner wall 20, with the edge of the latter cooperating with the adjacent edge of top member 6 to form a debris receiving opening 21. Because outer wall 19 of each pan 14, 15 provides the leading or trailing portion of the sweeper during use, bumper means are disposed on the exposed side of each such wall. For this purpose, and as best shown in FIG. 8, the outer portion of wall 19 is formed with a pair of undercuts 22 which are adapted to receive the facing edges of a flexible stretchable resilient bumper strip 23. Strip 23 is suitably stretched around and over the pan edge and forms a tight fit, with no glue being necessary to hold it in place.

Figure 11:
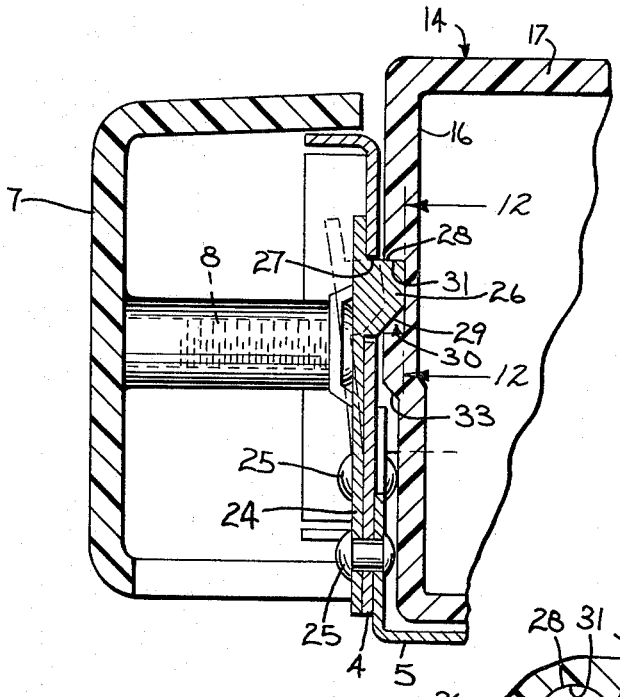
FIG. 11 is a fragmentary sectional view of the pan latch area.
Figure 12:
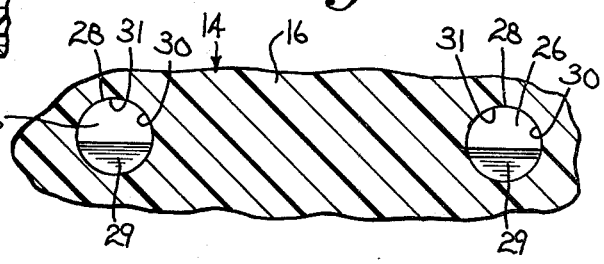
FIG. 12 is an enlarged section taken on line 12—12 of FIG. 11 and showing a pair of latch buttons.
Figure 13:
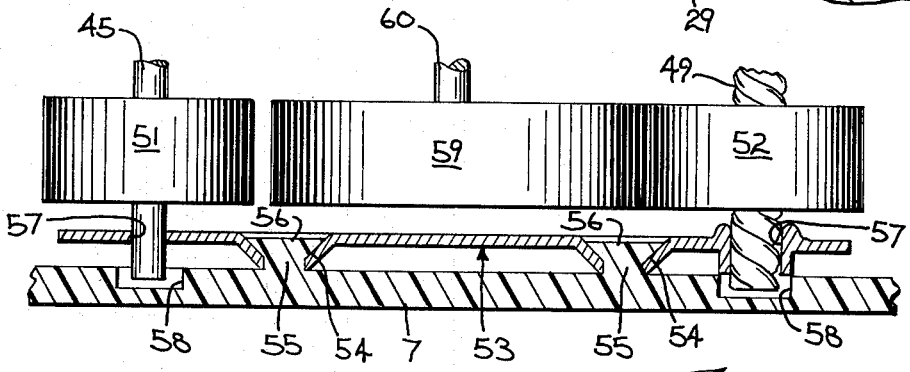
FIG. 13 is an enlarged fragmentary section taken on line 13—13 of FIG. 6 and showing the brush axle mounting.
Figure 14:
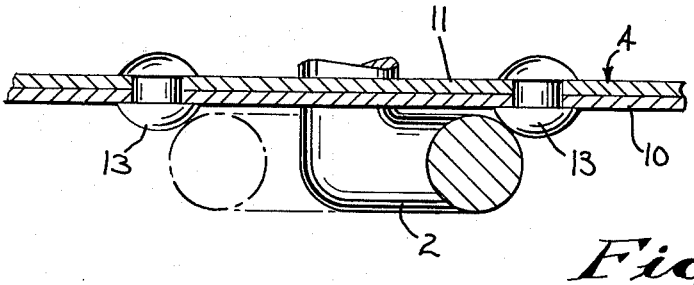
FIG. 14 is an enlarged fragmentary section taken on line 14—14 of FIG. 6 and showing the bail detent construction.

Dust pans 14 and 15 are adapted for insertion between end plates 4. Pan latching and positioning devices are mounted on plates 4 for cooperation with the pan end walls 16. For this purpose, and as best shown in FIGS. 4, 6, 11 and 12, each outer end portion of plates 4 carries a springable latch plate 24 on its outer face, with the lower portion of plate 24 being secured to plate 4 as by rivets 25. A pair of horizontally spaced latch buttons 26 are disposed on the upper portion of each latch plate 24 and extend inwardly through openings 27 in the respective end plate 4 into the dust pan receiving area. Referring to FIGS. 11 and 12, each latch button 26 is shown as being generally circular and having a curved top ledge portion 28 and an inclined ramp-like lower cam portion 29.

The end walls 16 of each dust pan are each provided with a pair of generally cylindrical latch receiving recesses 30 having radiused generally horizontal top edges 31 and similar lower edges. A pair of ramps 33 is formed in wall 16 with ramps 33 spaced below recesses 30.

Figure 6:
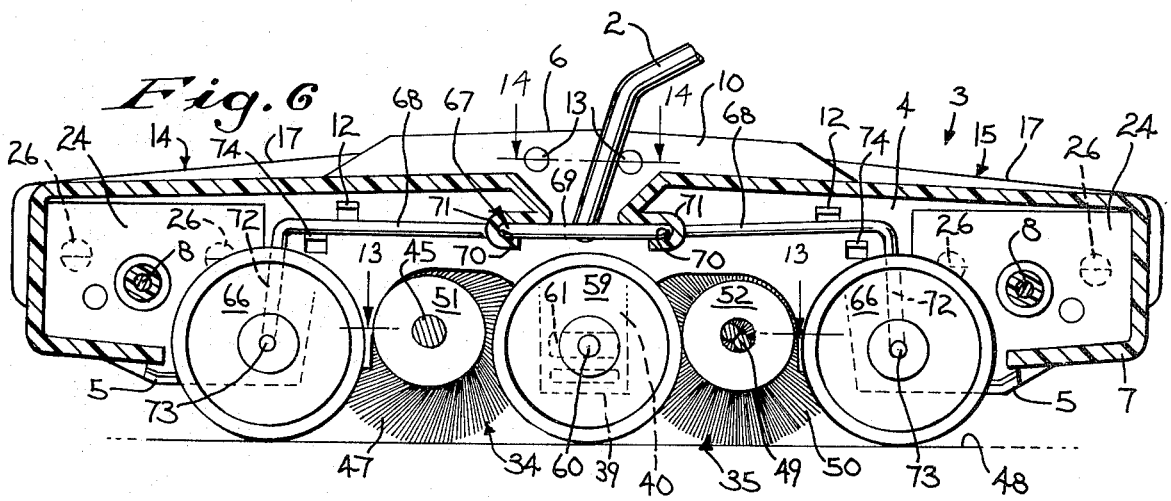
FIG. 6 is a longitudinal section taken on line 6—6 of FIG. 4.

Upon insertion of a dust pan into the lower unit, each end wall 16 bypasses its respective latch buttons 26 until lower ramps 33 engage the top edges 31 of the buttons and force them outwardly against the biasing force of their latch plate 24. Upon continued lowering of the pan, latch buttons 26 will snap into recesses 30 in the pan walls and top opening edges 31 will ultimately come into engagement with curved button ledge portions 28. Ledge portions 28 thus function to supportingly suspend the dust pan in place. As shown in FIG. 6, the construction is such that each supported dust pan is positioned in spaced relationship above its respective brace member 5 and also touching but not supported by the adjacent edge of top member 6.

When a dust pan is removed upwardly for emptying, the lower edges of recess 30 engage lower latch cams 29, causing latch buttons 26 to spring outwardly from recesses 30 to thereby release the pan.

By using a pair of latch supports at each pan end, the respective pan is held firmly in a generally horizontal position and prevented from rocking on its axis.

Figure 4:
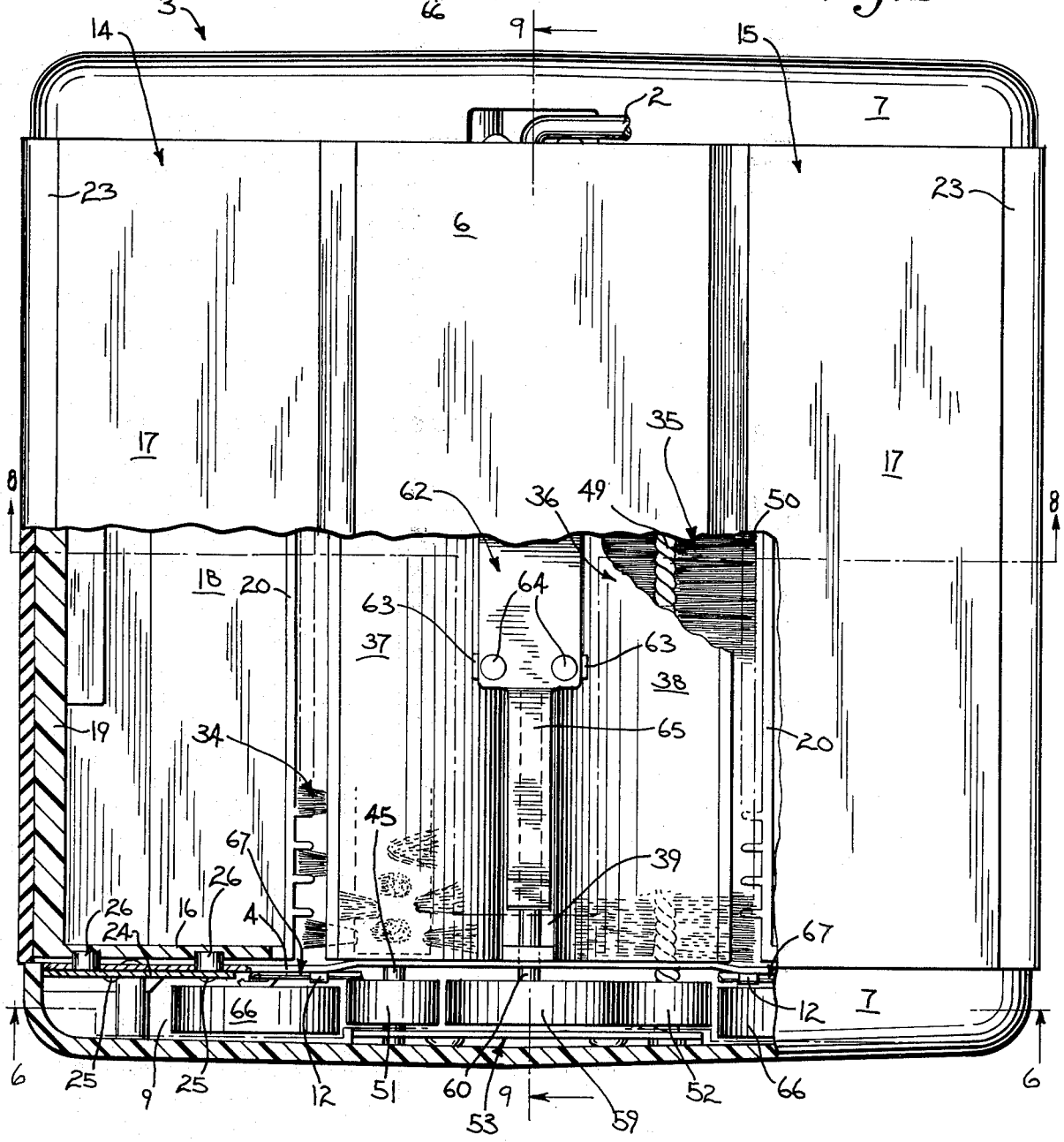
FIG. 4 is an enlarged top plan view of the sweeper lower unit with parts broken away and in section.
Figure 5:
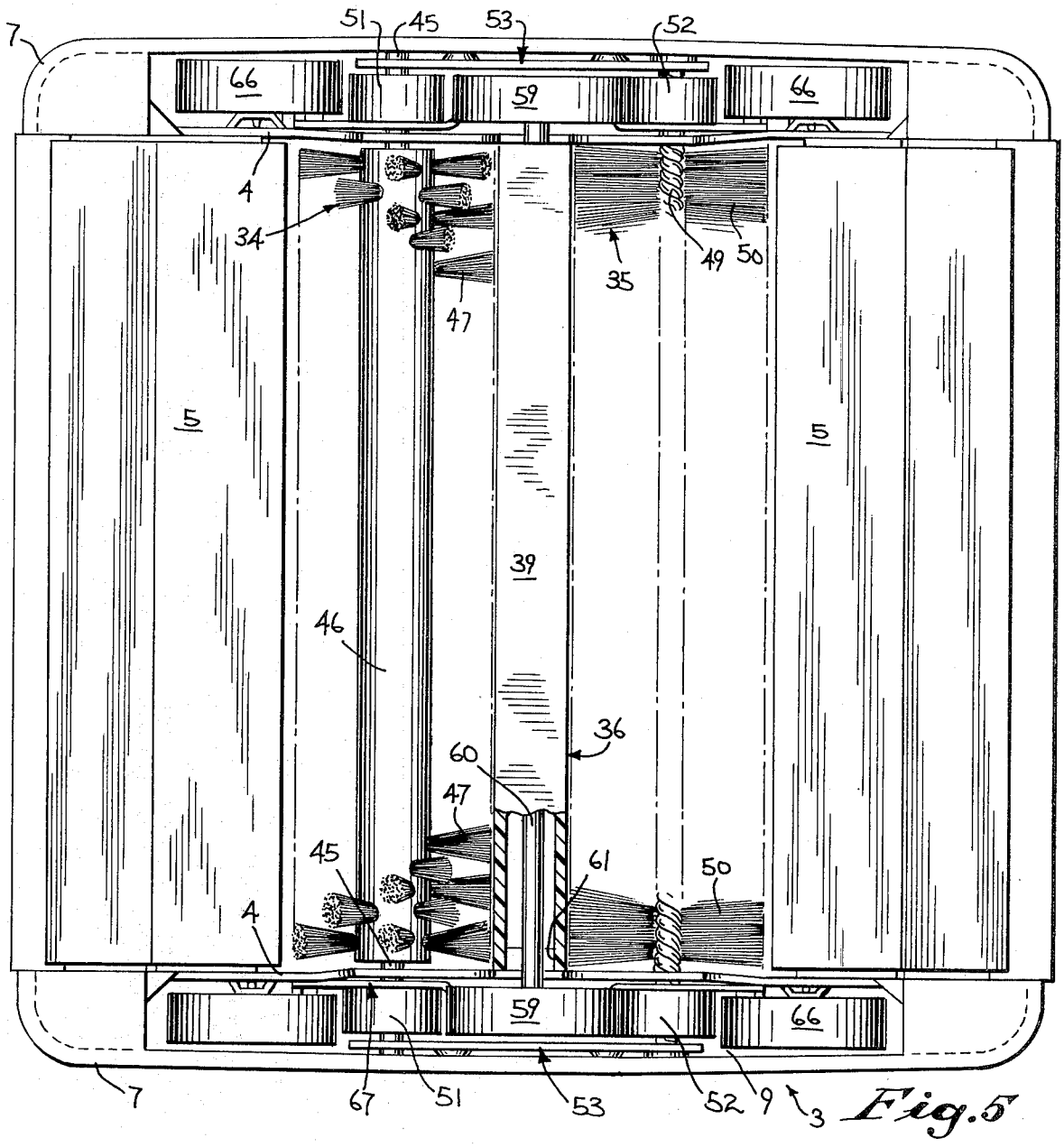
FIG. 5 is an enlarged bottom plan view of the sweeper lower unit with parts broken away and in section.

Referring to FIGS. 4, 5 and 8, the floor sweeper of the present invention incorporates a pair of transversely extending brush rollers 34, 35, with front brush roller 34 disposed directly behind dust pan 14 and rear brush roller disposed directly ahead of dust pan 15. In addition, a transversely extending unitary deflector 36 is centrally disposed between brush rollers 34 and 35 and is adapted to serve both rollers. For this purpose, deflector 36 comprises an elongated generally U-shaped shell having spaced forwardly and rearwardly facing curved deflector walls 37 and 38 respectively, which are joined at their lower ends by a flat horizontal wall 39. Deflector 36 is preferably made of plastic and is provided with transversely spaced end walls 40 which are secured to end plates 4 as by rivets 41. A flanged opening 42 in each end plate 4 engages a counterbore 43 in each end wall 40. The ends of bail 2 also extend through a drawneck in wall 4 which is disposed in a vertical slot in wall 40, which in combination with opening 42 holds deflector 36 in alignment. The deflector walls, together with sweeper top member 6, form an enclosed chamber 44.

In the embodiment shown, brush rollers 34 and 35 are adapted to have different debris pickup characteristics, with front brush roller 34 tending to pick up larger debris than rear brush roller 35.

Front brush roller 34 is constructed in a manner similar to that disclosed in the aforementioned U.S. Pat. No. 3,457,575. It includes an axle 45 and a core 46 in which are anchored a plurality of flexible bristles 47 in the form of tufts. The tufts are mounted off center at an angle to the radial direction and angularly to the circumferential core surface. The result is that when brush roller 34 rotates in contact with a floor 48, its bristles tend to flick debris from the floor.

Rear brush roller 35 is of the so-called wire twist type. Its axle 49 is formed of twisted wire which frictionally anchors a plurality of generally radially extending non-tufted bristles 50 which extend continuously along the axle.

The axle end portions of brush rollers 34 and 35 carry respective coupling wheels 51 and 52 which are disposed in chambers 9. In addition, the axles are supported in the sweeper in a unique manner. For this purpose, and referring particularly to FIG. 13, a mounting plate 53 is secured to each end cap 7. Plate 53 includes openings 54 struck out of the plate and which receive pins 55 which extend inwardly from the plastic end cap 7. After assembly, the plastic pins are deformed, as shown at 56, as by sonic welding, to lock the members together. Mounting plate 53 is provided with suitable openings 57 which receive axles 45 and 49 therethrough. The axle ends extend into recesses 58 formed in the inner wall of cap 7.

The construction is such that the brush roller axle ends are not visible in the assembled sweeper, and removal of end caps 7 provides immediate access to the brush rollers.

A single center-mounted drive means is provided which serves both brush rollers. For this purpose, a pair of drive wheels 59 are mounted at the ends of a drive axle 60 and are disposed in chambers 9. Axle 60 extends through the lower portion of deflector chamber 44 and is journalled in slots 61 in deflector end walls 40. Slots 61 are of a shape to permit both vertical and horizontal movement of axle 60 and its associated wheels 59.

Figure 9:
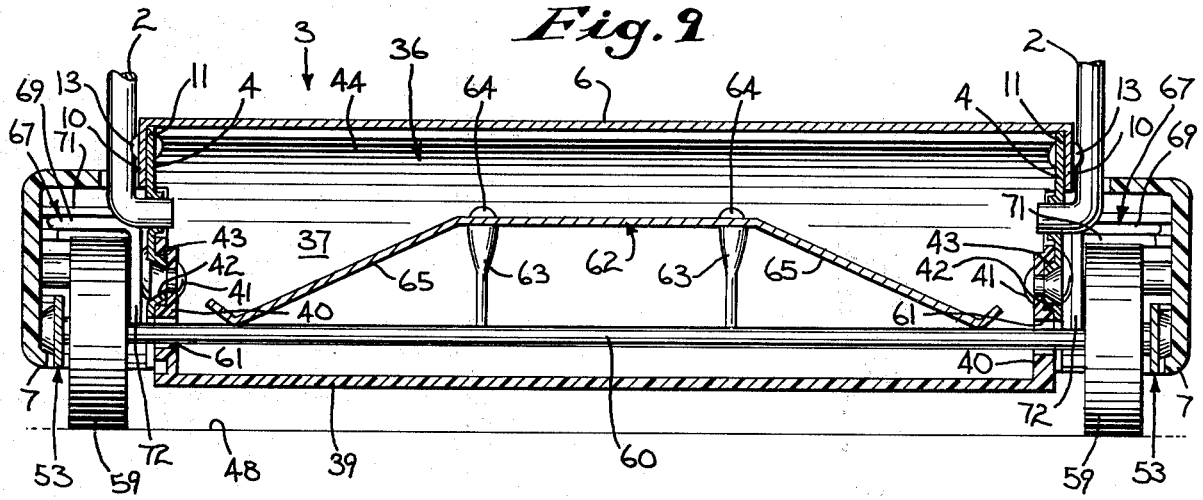
FIG. 9 is a transverse section taken on line 9—9 of FIG. 4.

As shown in FIGS. 4 and 9, the drive assembly is adapted for floating action, and is biased downwardly by a leaf spring 62 which is mounted on bosses 63 formed in the interior walls of deflector 36 and which is secured thereto as by sonic welds 64. Leaf spring 62 has a pair of end legs 65 which extend downwardly within deflector chamber 44 and which biasingly engage the top of drive wheel axle 60.

Upon forward movement of the sweeper over floor 48, coupling wheels 51 are out of engagement with drive wheels 59. However, because of the type of front brush construction, brush roller 34 free wheelingly rotates to flick debris up along deflector wall 37 and then longitudinally forwardly through opening 21 into front dust pan 14. When the sweeper moves rearwardly, drive wheels 59 move into engagement with coupling wheels 51 and positively drive the brush roller in the same direction as its free wheeling direction. Front brush roller 34 thus rotates continuously in the same direction.

The cooperation of front brush roller 34 with deflector 36, together with the relative positions of the parts, as well as the fact that roller 34 tends to pick up larger items before they are reached by brush roller 35, makes it possible to utilize dust pans which are high off the floor, and to also position the deflector bottom wall 39 approximately as high off the floor as the pans during sweeper use.

Likewise, upon forward movement of the sweeper over floor 48, drive wheels 59 move into engagement with rear coupling wheels 52 to positively drive rear brush roller 35 so that it carries debris up along deflector wall 38 and then longitudinally rearwardly through opening 21 into rear dust pan 15. When the sweeper moves rearwardly, drive wheels 59 move out of engagement with coupling wheels 52. In this instance, rear brush roller 35 will tend to freely roll along the floor in the same direction as its driven direction.

Drive wheels 59, being centrally located in lower unit 3, cannot be the sole support for the sweeper on floor 48, lest the sweeper undesirably tips back and forth about drive axle 60. Therefore, four freely rotatable support wheels 66 are provided in chamber 9 with wheels 66 disposed adjacent but slightly inwardly of the corners of lower unit 3, and just outwardly of brush rollers 34 and 35.

Figure 10:
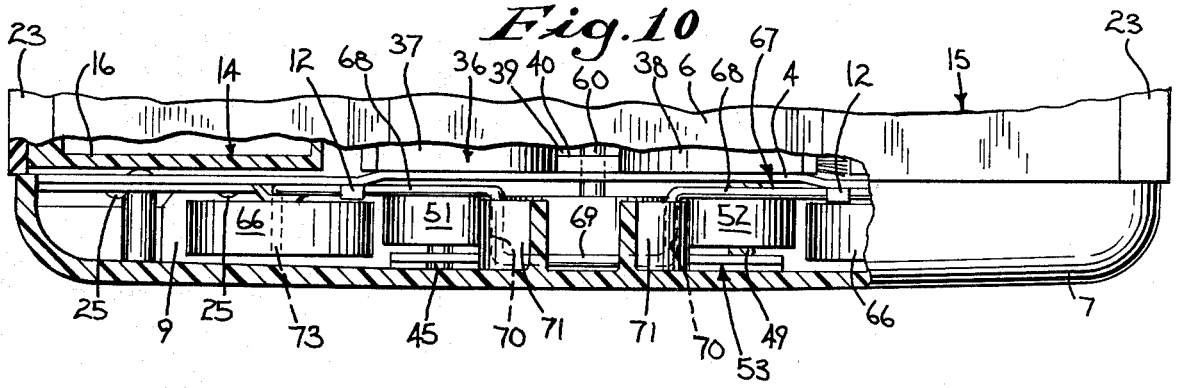
FIG. 10 is a partial top view of one end of the sweeper lower unit, with parts broken away and in section.

As best shown in FIGS. 6 and 10, the mounting means for support wheels 66 comprises an elongated wire spring 67 disposed on the outer face of each end plate 4 in chamber 9. Spring 67 comprises a pair of generally horizontal springably floating arms 68 which are joined by a generally U-shaped central portion 69 which is offset transversely outwardly. Portion 69 is fixedly held between slots 70 formed in a pair of spaced projections 71 which are integral with and extend inwardly from the respective end cap 7. Arms 68 merge at their outer ends into generally downwardly extending legs 72, and wheels 66 are mounted on stub axles 73 extending transversely outwardly from the legs. Spring arms 68 are confined between lower stops 74 formed outwardly in the respective end plate 4, and upper stops 12 which as heretofore described also serve as the locating seat for the end flanges 10 of top member 6 as shown in FIG. 8.

FIG. 6 shows the sweeper supporting elements in generally intermediate position when lower unit 3 is freely resting on a floor 48.

Figure 7:
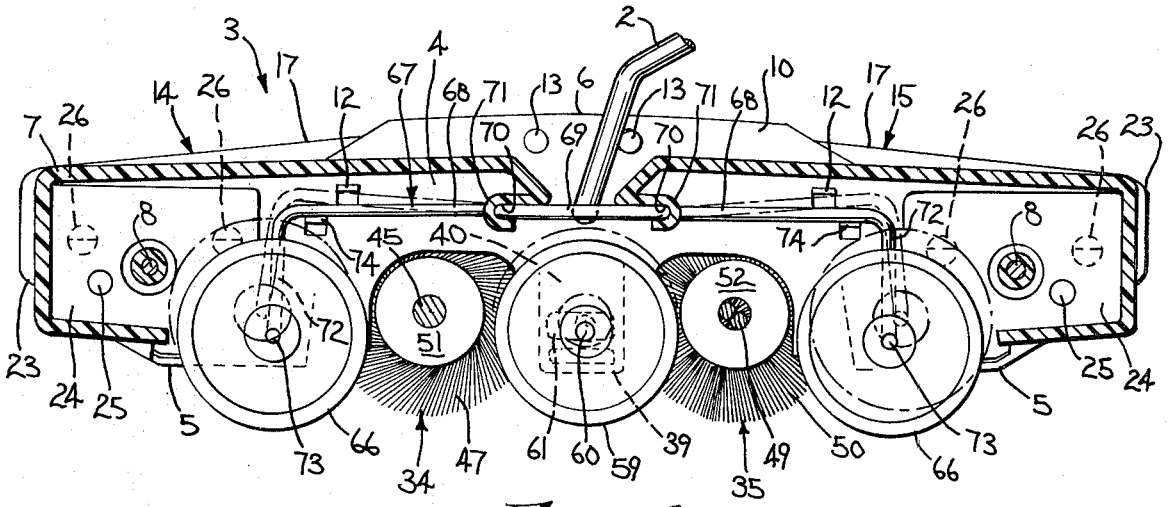
FIG. 7 is a view similar to FIG. 6 and showing the range of movement of the floating wheels.
Figure 3:
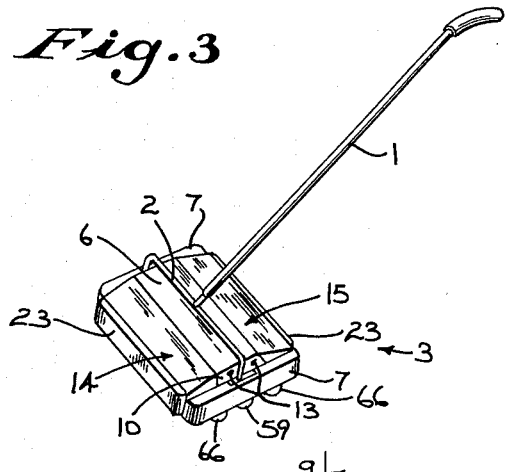
FIG. 3 is a perspective view of a floor sweeper constructed in accordance with the present invention.

In FIG. 7, the full line showing illustrates the relative positions of the parts when lower unit 3 is out of contact with the floor. Drive wheels 59 are at their lowest position, due to the spring loading of axle 60 against the lower edges of the respective slots 61. Support springs 67 are disposed adjacent lower stops 74 so that corner wheels 66 are also at their lowest position and spaced slightly from coupling wheels 51 and 52.

Since drive wheels 59 and support wheels 66 are floatingly mounted, when lower unit 3 is brought into engagement with the floor, the parts will assume the positions shown in phantom in FIG. 7. As the sweeper is pressed down and digs in, drive wheels 59 float up until axle 60 engages the upper edges of slots 61, which form stops. At the same time, spring arms 68 pivot upwardly about the respective holding projections 71 causing stub axles 73 and wheels 66 to move in an arc outwardly and upwardly away from each other and from coupling wheels 51 and 52. This spreading movement prevents interference between wheels 66 and the coupling wheels as the sweeper engages the carpet.

The upper stops 12 are disposed relative to the top of slots 61 so that support wheels 66 are free to float higher than drive wheels 59. This assures that drive wheels 59 will have firm contact with the floor at all times, no matter what tilting forces are applied by the operator during fore and aft translation of the sweeper over the floor.

Various modes of carrying out the invention are contemplated as being within the scope of the following claims particularly pointing out and distinctly claiming the subject matter which is regarded as the invention.

I claim:

1. In a floor sweeper having a handle and a bail attached to said handle, a lower sweeping unit attached to said bail and comprising:

(a) a frame having transversely spaced longitudinally extending end plates, (b) dust pans disposed at the front and rear end portions of said frame, (c) front and rear transversely extending uni-directionally rotatable brush rollers disposed inwardly from the respective front and rear dust pans, (d) means to rotatably drive said brush rollers, (e) and transversely extending deflector means disposed centrally between and serving both said front and rear brush rollers to assist said rollers in carrying debris up from the floor and hence longitudinally outwardly into the respective dust pans.

2. The floor sweeper of claim 1 wherein:

(a) said drive means comprises:

(1) an axle, (2) and floor engaging drive wheels disposed on the ends of said axle, (b) and said deflector means comprises:

(1) transversely spaced end walls joining forwardly and rearwardly facing curved deflector walls, (2) said curved deflector walls receiving said axle therebetween, (3) and said end walls providing mounting means for said axle.

3. The floor sweeper of claim 2:

(a) wherein said mounting means comprises openings in said end walls which floatingly receive said axle therethrough, (b) and which includes spring means disposed between said deflector walls for biasing said axle downwardly in said openings.

4. The floor sweeper of claim 3:

(a) which includes a bottom wall joining the lower ends of said forwardly and rearwardly facing deflector walls, (b) said bottom wall being positioned to be about as high off the floor as said dust pans during sweeper use.

5. The floor sweeper of claim 3 wherein said frame end plates and said deflector end walls provide bail mounting means.

6. The floor sweeper of claim 1 or 5:

(a) which includes a transversely extending lower unit top portion having end flanges and with said flanges engaging said end plates, (b) and which includes longitudinally spaced securing means joining said flanges and said plates, (c) said securing means forming detent means for positioning the said bail relative to the said lower unit.

7. The floor sweeper of claim 3:

(a) which includes:

(1) caps removably mounted to said end plates of said lower unit frame, (2) a spring mounted to each cap, with each said spring having a pair of springably floating arms with end portions terminating in axles, (3) freely rotatable sweeper support wheels mounted to said axles for floating movement therewith, (4) and upper and lower stop means for said floating arms with said stop means being disposed on the adjacent said frame end plates, (b) and wherein said upper stop means are disposed relative to the top of said openings in said end walls of said deflector means so that said rotatable support wheels are floatable higher than said drive wheels during sweeper use.

8. The floor sweeper of claim 1:

(a) wherein said dust pans are removable upwardly from the said lower unit, (b) and which includes means for suspending said dust pans by their ends in the said lower unit.

9. The floor sweeper of claim 8 wherein said pan suspending means comprises:

(a) spring means disposed on said frame end plates, (b) at least one latch element disposed on said spring means and extending inwardly toward the respective pan end, said latch element having a pan supporting ledge portion thereon, (c) the end of the pan having a surface for resting on said ledge portion, (d) and means on the end of the pan for biasing said spring means and latch element away from the pan during insertion and during removal of the pan from the lower unit.

10. The floor sweeper of claim 9 which includes a plurality of horizontally spaced latch elements on said spring means for preventing rocking of a supported pan on its axis.

11. The floor sweeper of claim 8, 9 or 10:

(a) which includes a transversely extending centrally disposed lower unit top portion, (b) and transverse brace means joining said end plates and disposed beneath said dust pans, (c) the construction being such that said suspending means supports said dust pans in spaced relation above said brace means.

12. The floor sweeper of claim 1 which includes caps removably mounted to said end plates of said lower unit frame.

13. The floor sweeper of claim 12 which includes:

(a) a spring mounted to each cap, with each said spring having a pair of springably floating arms with end portions terminating in axles, (b) freely rotatable sweeper support wheels mounted to said axles for floating movement therewith, (c) and upper and lower stop means for said floating arms with said stop means being disposed on the adjacent said frame end plates.

14. The floor sweeper of claim 13 wherein said spring end portions and support wheels move arcuately outwardly and upwardly in a spreading movement upon engagement of the lower unit with a floor.

15. The floor sweeper of claim 13:

(a) which includes a transversely extending lower unit top portion having end flanges and with said flanges engaging said end plates, (b) and said upper stop means for said spring functions as a locating seat means for said end flanges.

16. The floor sweeper of claim 12 or 13 which includes means on said caps for mounting the ends of said brush rollers.

17. In a floor sweeper:

(a) a handle, (b) a bail attached to said handle, (c) a lower unit attached to said bail, and with said lower unit having a frame with transversely spaced longitudinally extending end plates, (d) a transversely extending lower unit top portion having end flanges and with said flanges engaging said end plates, (e) and longitudinally spaced securing means joining said flanges and said plates, (f) said securing means forming detent means for positioning the said bail relative to the said lower unit.

18. In a floor sweeper:

(a) a handle, (b) a bail attached to said handle, (c) a lower unit attached to said bail, and with said lower unit having a frame with transversely spaced longitudinally extending end plates, (d) a dust pan removable upwardly from said lower unit, (e) spring means disposed on said frame end plates, (f) at least one latch element disposed on said spring means and extending inwardly toward the respective pan end, said latch element having a pan supporting ledge portion thereon, (g) the end of the pan having a surface for resting on said ledge portion, (h) and means on the end of the pan for biasing said spring means and latch element away from the pan during insertion and during removal of the pan from the lower unit.

19. The floor sweeper of claim 18 which includes a plurality of horizontally spaced latch elements on said spring means for preventing rocking of a supported pan on its axis.

20. The floor sweeper of claim 19:

(a) which includes a transversely extending lower unit top portion, (b) and transverse brace means joining said end plates and disposed beneath said dust pan, (c) the construction being such that said suspending means supports said dust pan in spaced relation above said brace means.

21. In a floor sweeper:

a handle, (b) a bail attached to said handle, (c) a lower unit attached to said bail, and with said lower unit having a frame with transversely spaced longitudinally extending end plates, (d) a transversely extending lower unit top portion having end flanges and with said flanges engaging said end plates, (e) caps removably mounted to said end plates of said lower unit frame, (f) a spring mounted to each cap, with each said spring having a pair of springably floating arms with end portions terminating in axles, (g) freely rotatable sweeper support wheels mounted to said axles for floating movement therewith, (h) and upper and lower stop means for said floating arms with said stop means being disposed on the adjacent said frame end plates, (i) said spring end portions and support wheels being movable arcuately outwardly and upwardly in a spreading movement upon engagement of the lower unit with a floor, (j) said upper stop means for said spring functioning as a locating seat means for said end flanges.

* * * * *